US011718507B2

(12) United States Patent
Kim

(10) Patent No.: US 11,718,507 B2
(45) Date of Patent: Aug. 8, 2023

(54) PILE LIFTING DEVICE CAPABLE OF PREVENTING OVERTURNING

(71) Applicant: Kyu Sang Kim, Seoul (KR)

(72) Inventor: Kyu Sang Kim, Seoul (KR)

( * ) Notice: Subject to any disclaimer, the term of this patent is extended or adjusted under 35 U.S.C. 154(b) by 0 days.

(21) Appl. No.: 17/753,151

(22) PCT Filed: Aug. 25, 2020

(86) PCT No.: PCT/KR2020/011284

§ 371 (c)(1),
(2) Date: Feb. 22, 2022

(87) PCT Pub. No.: WO2021/040362

PCT Pub. Date: Mar. 4, 2021

(65) Prior Publication Data

US 2022/0274807 A1 Sep. 1, 2022

(30) Foreign Application Priority Data

Aug. 29, 2019 (KR) ..... 10-2019-0106730

(51) Int. Cl.
*B66C 1/66* (2006.01)
*E02D 13/04* (2006.01)
*E02D 11/00* (2006.01)

(52) U.S. Cl.
CPC ..... *B66C 1/66* (2013.01); *E02D 11/00* (2013.01); *E02D 13/04* (2013.01)

(58) Field of Classification Search
CPC E02D 11/00; E02D 13/04; B66C 1/56; B66C 1/66
See application file for complete search history.

(56) References Cited

FOREIGN PATENT DOCUMENTS

| | | | |
|---|---|---|---|
| JP | 54-159570 | A | 11/1979 |
| JP | 62-065485 | U | 4/1987 |
| JP | 02-169491 | A | 12/1988 |
| JP | 01-094391 | U | 6/1989 |
| JP | 2000-302369 | A | 10/2000 |
| JP | 2004-100260 | A | 4/2004 |
| JP | 2015-206208 | A | 11/2015 |
| JP | 2020-515750 | A | 5/2020 |
| KR | 10-2014-0102078 | A | 8/2014 |
| KR | 10-2015-0089027 | A | 8/2015 |
| KR | 10-2018-0103274 | A | 9/2018 |
| KR | 10-20141314 | B1 | 8/2020 |

OTHER PUBLICATIONS

ISR: Korean Intellectual Property Office; dated Nov. 30, 2020.

*Primary Examiner* — Sean D Andrish
(74) *Attorney, Agent, or Firm* — Patshegen IP; Moshe Pinchas

(57) ABSTRACT

A pile lifting chuck including a chuck housing which is inserted into an inner diameter of a pile and has extension-installing pockets vertically formed at predetermined intervals to face each other in a radial direction. The pile lifting chuck further includes a pair of extensions which are disposed in the pockets and installed to be movable in the radial direction and a chucking cylinder which has one end connected to any one of the extensions and the other end connected to the other one of the extensions and which is configured to, by using a reaction force on the any one of the extensions, move the other one of the extensions to chuck the pile.

3 Claims, 16 Drawing Sheets

Prior Art

PILE LIFTING DEVICE CAPABLE OF PREVENTING OVERTURNING

BACKGROUND

1. Field of the Invention

The present disclosure relates to a pile lifting device used in lifting piles during civil engineering or construction work, and more particularly, to a pile lifting device capable of preventing the overturning of piles that can lift piles by chucking the piles using hydraulic pressure and prevent the overturning of the piles while the piles are lifted, thus preventing accidents.

2. Discussion of Related Art

Generally, as a method of lifting piles on site, as illustrated in FIG. 16A, there is a method in which a noose is formed using a wire (101) and hung on an upper portion of a pile (100) to lift the pile (100). In this case, when the noose is formed using a wire (101) is detached from the pile (100), the pile (100) being lifted may overturn and cause an accident. As another lifting method, as illustrated in FIG. 16B, a method in which an eye bolt is fastened into a bolt hole at a distal end of a pile (100) and a wire (101) is hung on the eye bolt to lift the pile (100) is known. However, even in this case, when the eye bolt loosens, the pile (100) being lifted may overturn and cause an accident. Therefore, there is a need for a pile lifting device that eliminates the risk of piles overturning during lifting of the piles.

As related art of the present disclosure, Korean Utility Model Registration No. 20-0283330 proposes a "pile lifting device." Two mounters having a plurality of fixing pieces protruding therefrom are symmetrically installed at certain portions of a pile and fastened using a wire, and then the wire is hung on a hook fixed to one end of a rope of a crane and the rope is pulled to easily lift the pile. However, the related art has a disadvantage in that, when the wire loosens, the pile may overturn while being lifted and thus cause an accident.

As another related art of the present disclosure, Korean Patent Registration No. 10-1743358 proposes a "pile lifting device." A fastening band is fixed to a pile, and then a lifting ring body disposed at a lower side of the fastening band is lifted using a lifting wire. However, the related art has a disadvantage in that, when a fastening force of the fastening band is released, the pile may overturn while being lifted and thus cause an accident.

(Patent Document 1) Korean Utility Model Registration No. 20-0283330

(Patent Document 2) Korean Patent Registration No. 10-1743358

SUMMARY OF THE INVENTION

The present disclosure is directed to providing a pile lifting device capable of preventing the overturning of piles that can lift piles by chucking the piles using hydraulic pressure and prevent the overturning of the piles even when chucking is released during lifting, thus preventing accidents.

According to an embodiment of the present disclosure, a pile lifting device capable of preventing the overturning of piles, which is connected to lifting equipment and used to lift piles, includes a balance plate which is connected to the lifting equipment to maintain a horizontal balance and a pile lifting chuck which is connected to the balance plate directly or via a first lifting cable and inserted into an upper inner diameter portion of the pile to hold the pile using a hydraulic force.

The pile lifting device may further include an overturning-preventing steel pipe which has an outer diameter and a certain length that allow insertion into an inner diameter of the pile and is connected to a lower end of the pile lifting chuck.

The pile lifting device may further include an overturning-preventing ring plate which has an overturning-preventing hole formed to accommodate an outer diameter of the pile and is connected to the balance plate via a second lifting cable.

The pile lifting chuck may include: a chuck housing which has a cylindrical portion having an outer diameter smaller than the inner diameter of the pile, extension-installing angular pockets which are vertically formed at predetermined intervals on an inner side of the cylindrical portion so as to face each other in a radial direction, and upper and lower flanges formed on upper and lower portions of the cylindrical portion; a pair of extensions which are disposed in the extension-installing angular pockets of the chuck housing and installed to be movable in the radial direction; and a chucking cylinder which has one end hinge-connected to any one of the pair of extensions and the other end hinge-connected to the other one of the pair of extensions and is configured to, during an extension operation, move the extensions in the radial direction to chuck the pile.

The pile lifting chuck may have a driving head formed on an upper portion to receive a rotational force from the outside.

BRIEF DESCRIPTION OF THE DRAWINGS

The above and other objects, features and advantages of the present disclosure will become more apparent to those of ordinary skill in the art by describing exemplary embodiments thereof in detail with reference to the accompanying drawings, in which.

DETAILED DESCRIPTION OF EXEMPLARY EMBODIMENTS

Hereinafter, the present disclosure will be described in detail with reference to embodiments proposed in the accompanying drawings. However, the proposed embodiments are only illustrative and provided for clear understanding of the present disclosure, and the present disclosure is not limited thereto.

Figure 1:
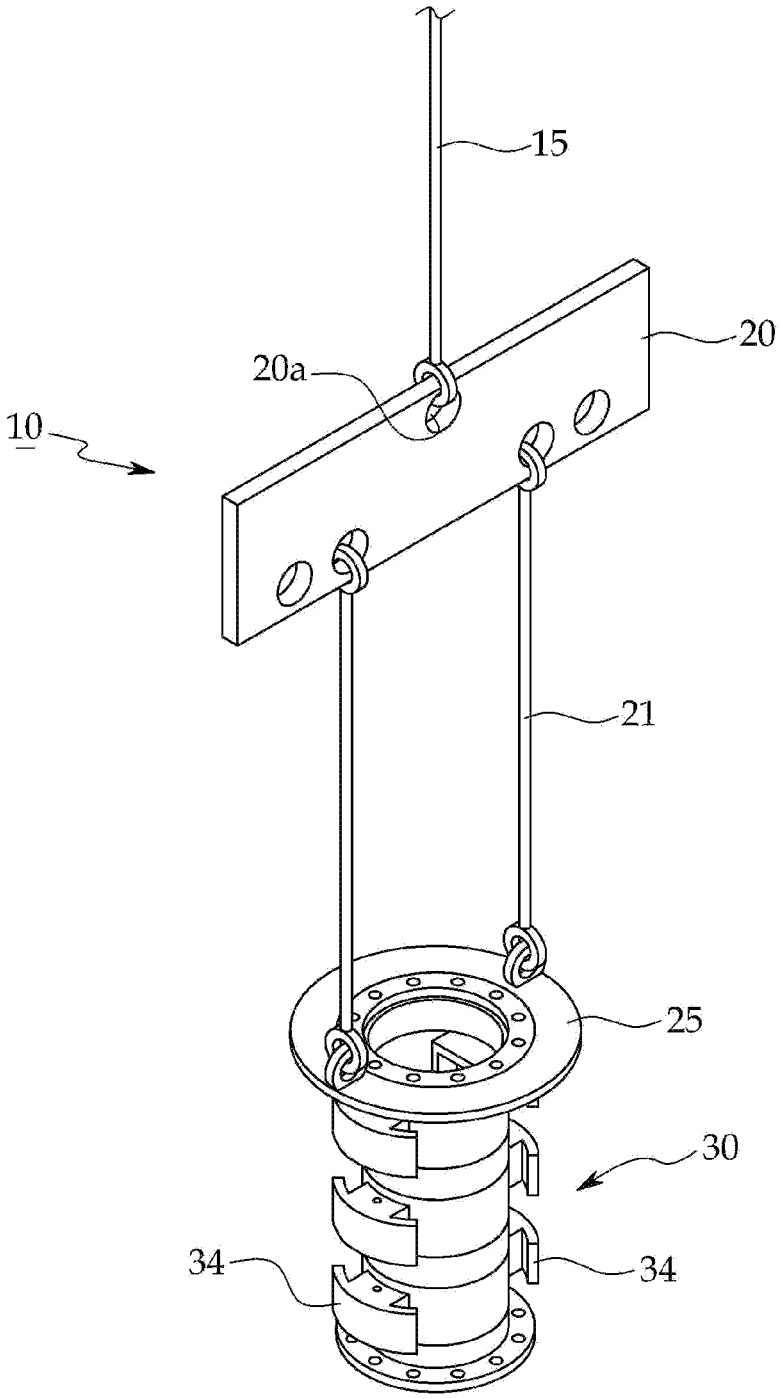
FIG. 1 is a perspective view of a pile lifting device according to a first embodiment of the present disclosure.
Figure 2:
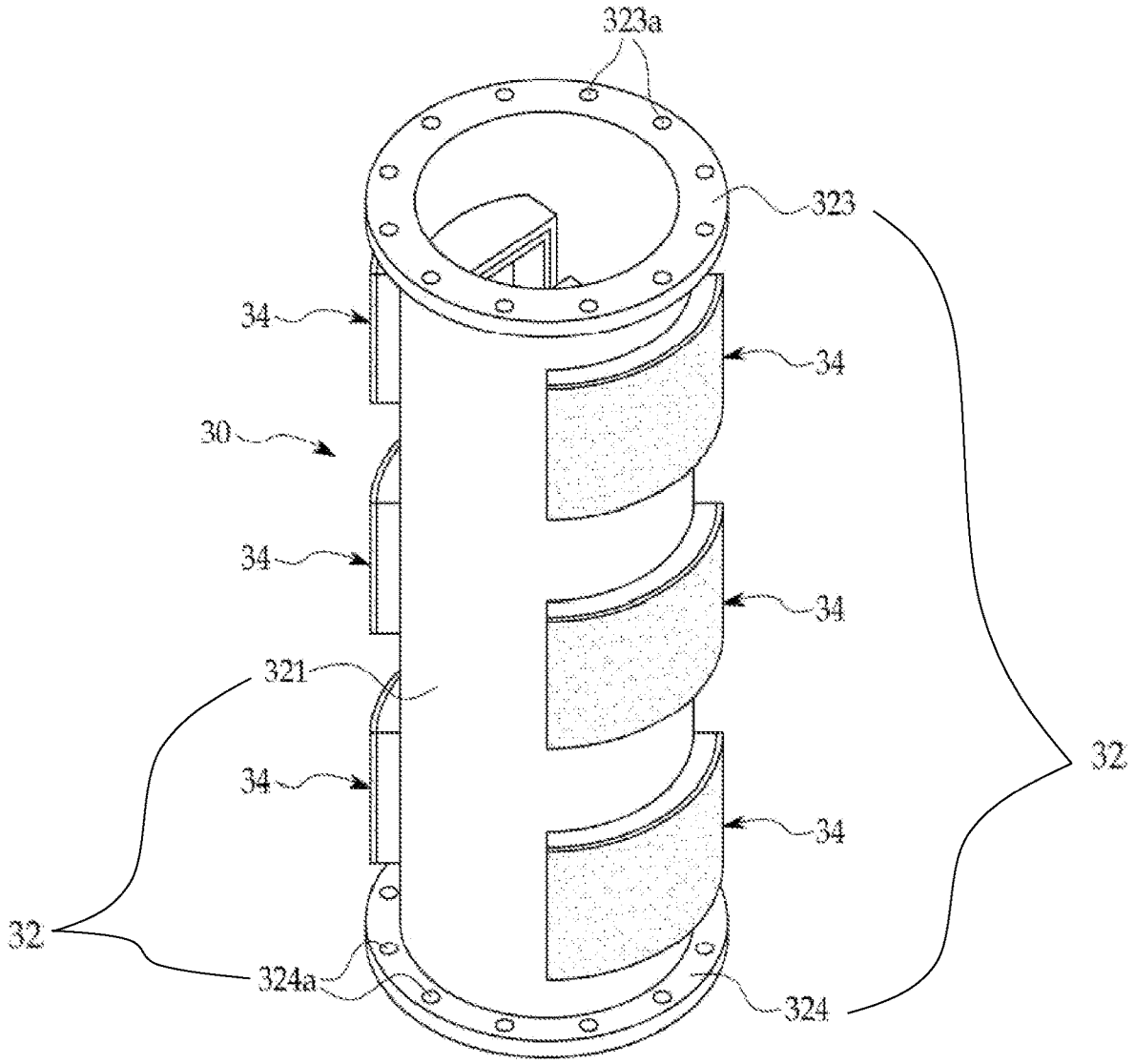
FIGS. 2 and 3 are perspective views of a pile lifting chuck illustrated in FIG. 1 and show states before and after operation of extensions.
Figure 3:
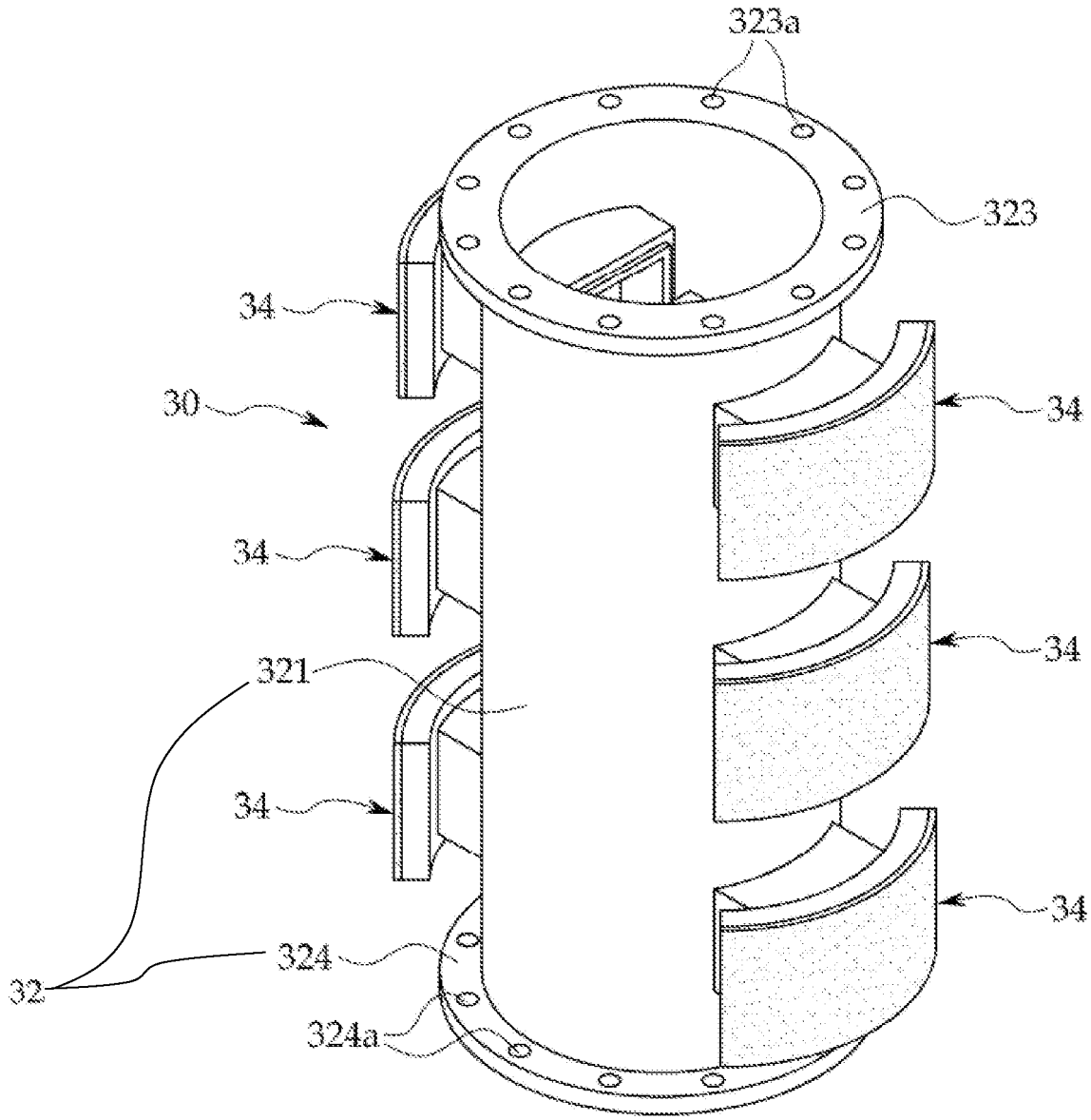
Figure 4:
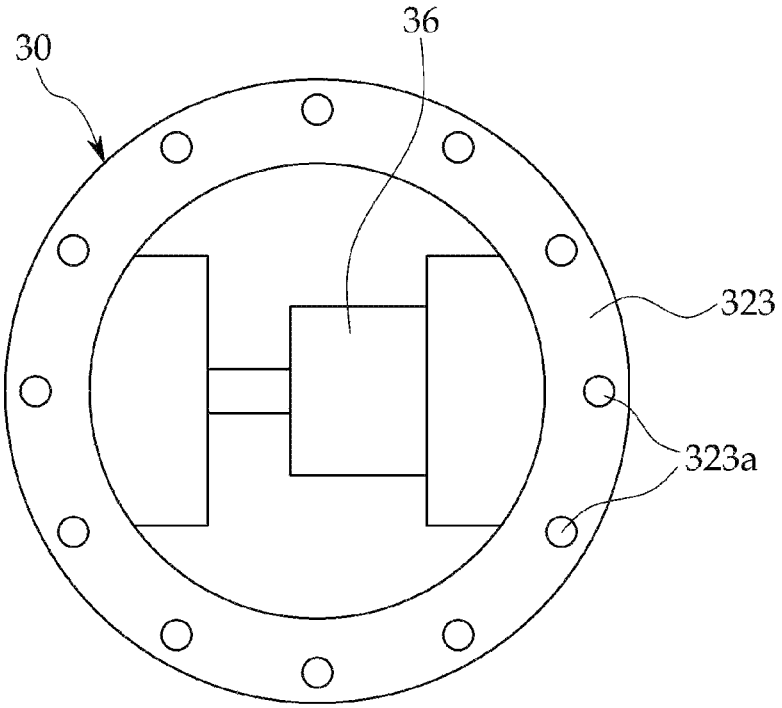
FIG. 4 is a plan view of FIG. 2.

A pile lifting device 10 according to the present disclosure that is illustrated in FIG. 1 allows a pile 100 to be chucked and lifted using a hydraulic force. Also, the pile lifting device 10 prevents the pile 100 from overturning while being lifted, thus allowing lifting to be more safely performed.

Here, the pile 100 has a hollow formed therein and may be a Pretensioned-spun High-strength Concrete (PHC) pile, a steel pipe pile, or the like.

Figure 7:
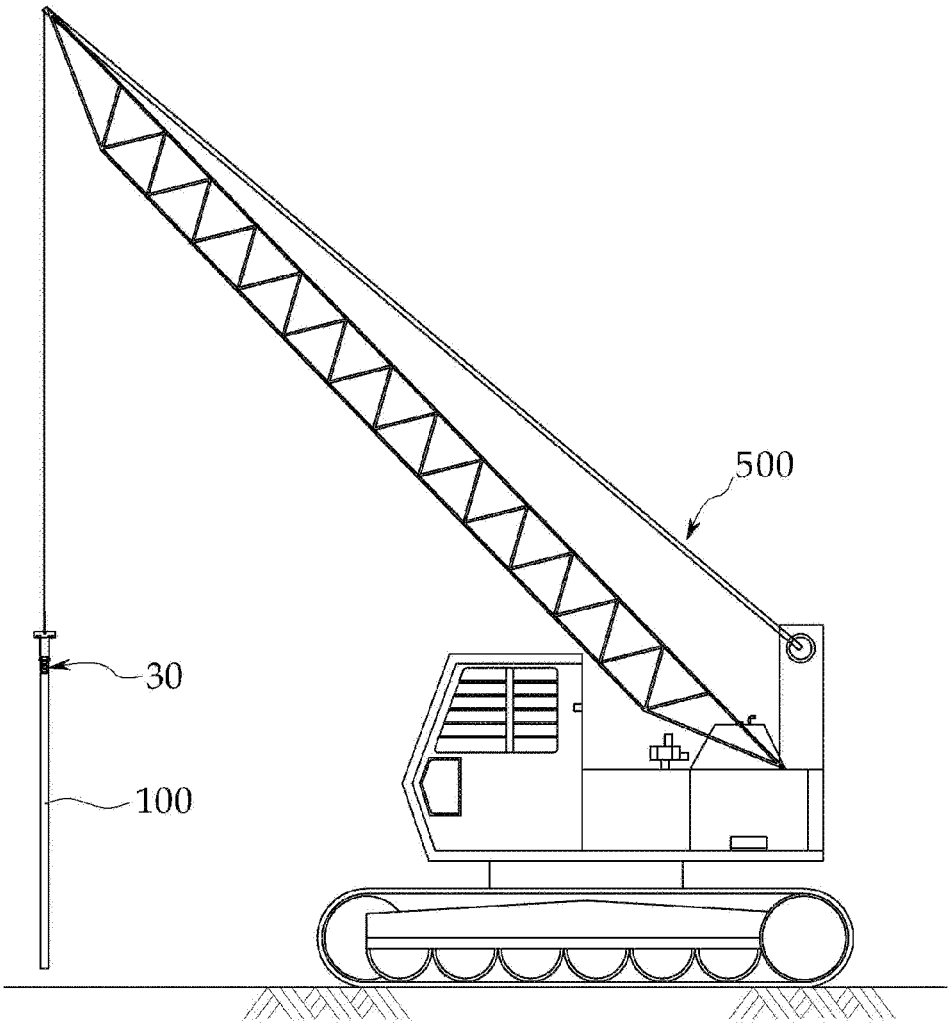
FIG. 7 is a view showing a state of lifting a pile using the pile lifting device of FIG. 1.

As illustrated in FIGS. 1 and 7, the pile lifting device 10 has a balance plate 20 connected to lifting equipment 500. Here, as an example of the lifting equipment 500, widely-known crane equipment may be used.

The balance plate 20 is formed in the shape of a plate having a predetermined thickness and includes a lifting hole 20*a* formed in a central upper portion and first lifting cables 21 connected to be symmetrical at a lower portion. A hook disposed at the lifting equipment may be directly connected to the lifting hole 20*a*, or a lifting rope 15 may be connected to the lifting hole 20*a* as illustrated. In the present embodiment, the balance plate 20 is configured in a quadrangular shape, but the shape of the balance plate 20 is not limited thereto.

A pile lifting chuck 30 is connected to the balance plate 20 via the plurality of first lifting cables 21. The pile lifting chuck 30 is inserted into an upper inner diameter portion of the pile 100 to hold the pile 100 using a hydraulic force.

Here, a lower end of the first lifting cable 21 may be connected to an upper extension ring 25, and the upper extension ring 25 may be welded or bolt-coupled to an upper end of the pile lifting chuck 30. Therefore, in this case, the first lifting cable 21 lifts the pile lifting chuck 30 via the upper extension ring 25.

As illustrated in FIGS. 2 to 6, the pile lifting chuck 30 is formed of a chuck housing 32, at least one pair of extensions 34 installed in the chuck housing 32, and a chucking cylinder 36 configured to extend the pair of extensions 34 in a radial direction.

Figure 6:
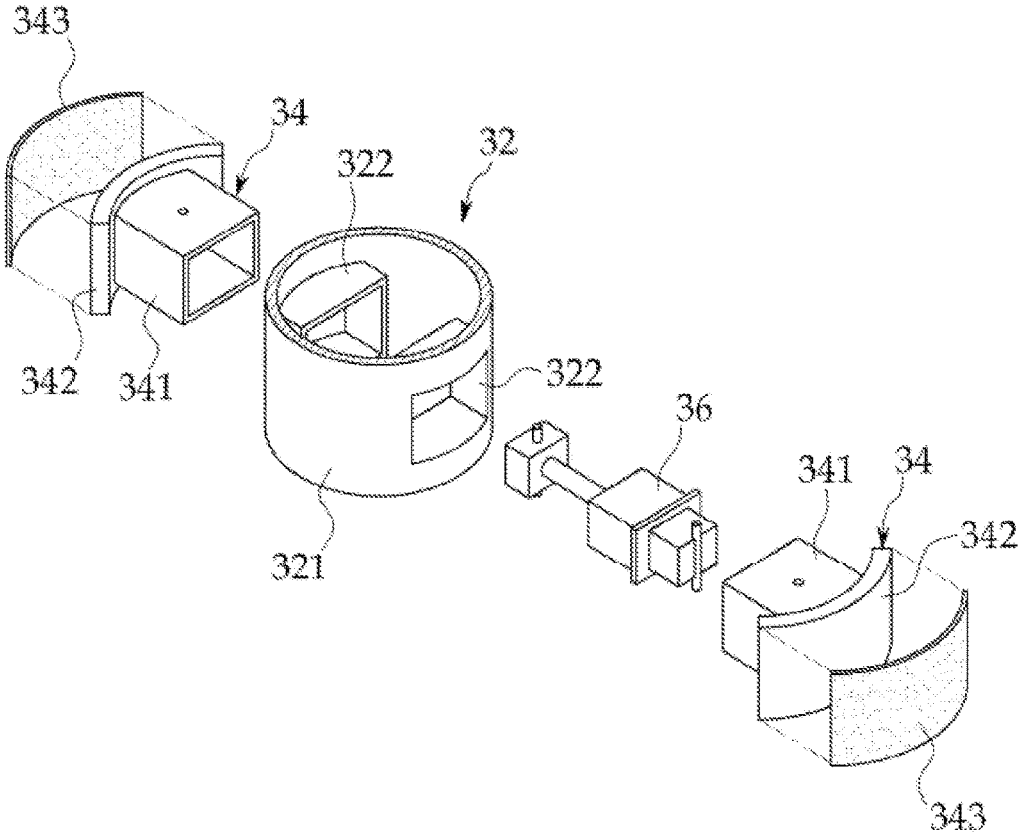
FIG. 6 is an exploded perspective view of a portion of the pile lifting device illustrated in FIG. 1.

The chuck housing 32 has a cylindrical portion 321 having an outer diameter smaller than an inner diameter of the pile 100, extension-installing angular pockets 322 which are vertically formed at predetermined intervals on an inner side of the cylindrical portion 321 so as to face each other in the radial direction, and upper and lower flanges 323 and 324 formed on upper and lower portions of the cylindrical portion 321. The upper and lower flanges 323 and 324 have fastening holes 323*a* and 324*a* each formed in a circular shape to be bolt-coupled when one or more pile lifting chucks 30 are connected to each other. The pair of extensions 34 are disposed in the extension-installing angular pockets 322 of the chuck housing 32 and installed to be movable in the radial direction. As illustrated in FIG. 6, the extension 34 is formed of an angular boss 341 having a polygonal cross-section and an engaging plate 342 having a radius of curvature equal to the inner diameter of the pile 100, which is an object to be lifted, and integrally formed with the angular boss 341. The chucking cylinder 36 has one end hinge-connected to any one of the pair of extensions 34 and the other end hinge-connected to the other one of the pair of extensions 34. Therefore, during an expansion operation of the chucking cylinder 36, the chucking cylinder 36 moves the extensions 34 in the radial direction to chuck the pile 100. A pressing rubber plate 343 may be further attached to the extension 34.

Figure 5:
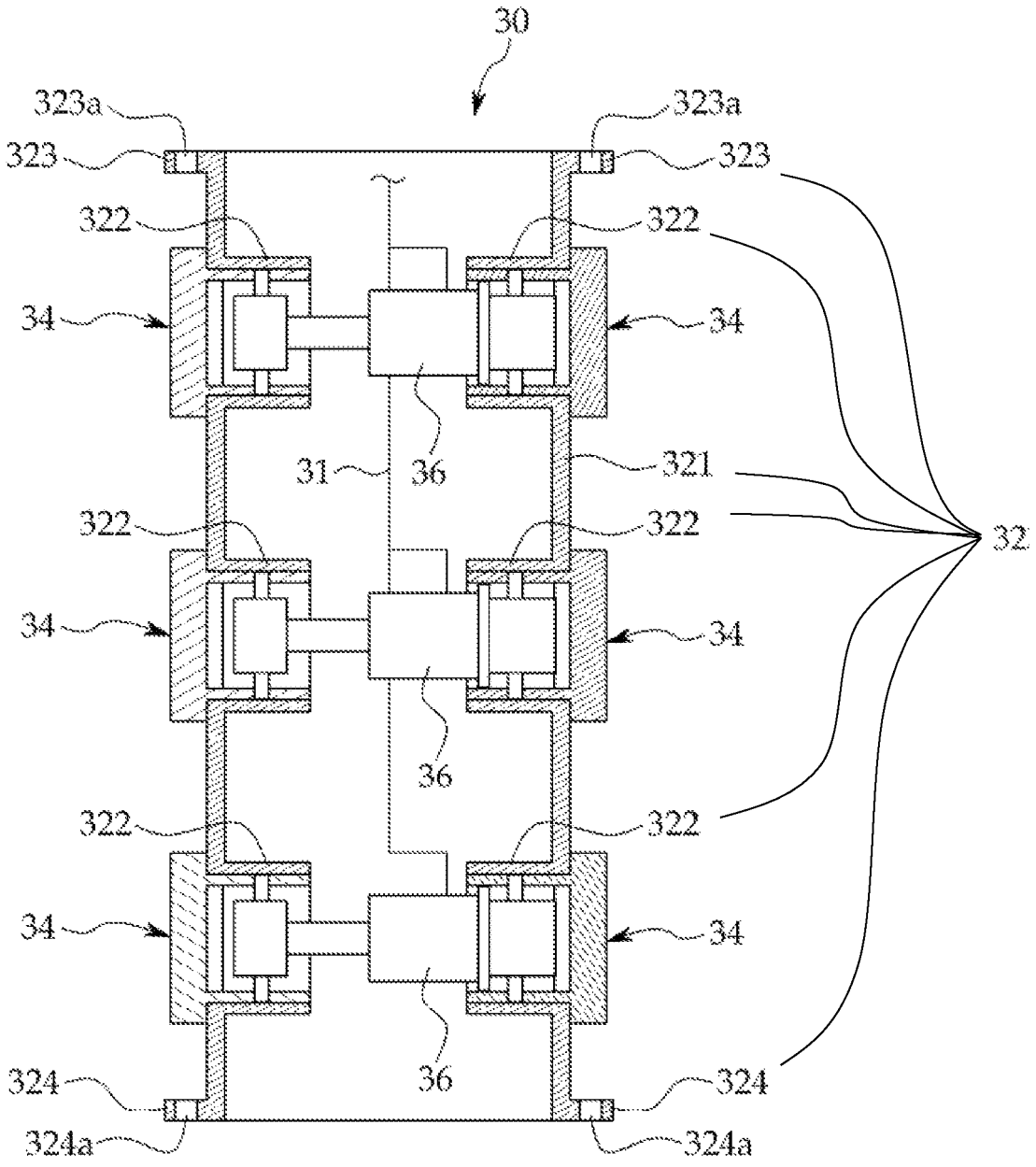
FIG. 5 is a longitudinal cross-sectional view of FIG. 2.

Here, as illustrated in FIG. 5, a pressurized oil supplied to the chucking cylinder 36 may be supplied through a pressurized oil line 31, and for example, the pressurized oil line 31 may be connected to a hydraulic system of the lifting equipment 500. Therefore, an operator of the lifting equipment 500 may control the chucking cylinder 36 to lift the pile.

Figure 8:
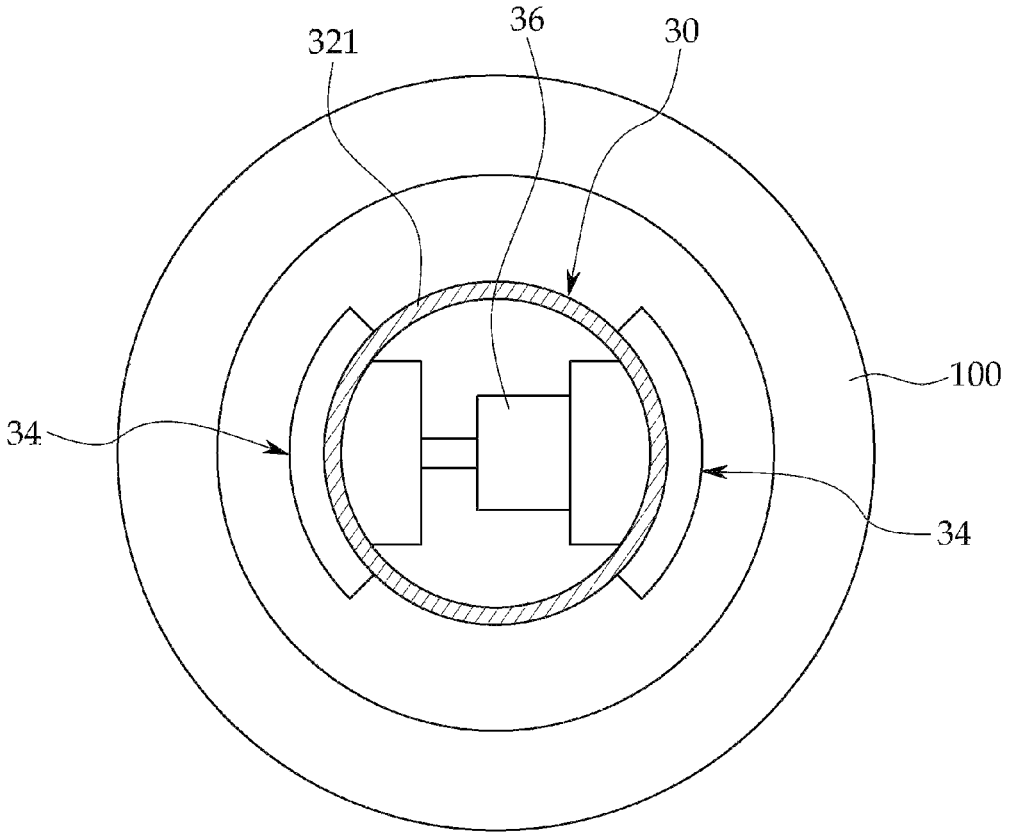
FIGS. 8 and 9 are views showing states before and after chucking a pile using the pile lifting device of the present disclosure.

In the pile lifting device 10 configured as above, in a state in which the balance plate 20 is connected to the lifting equipment 500 as illustrated in FIGS. 1 and 7, the pile lifting chuck 30 is inserted into the upper inner diameter portion of the pile 100 as illustrated in FIG. 8.

Figure 9:
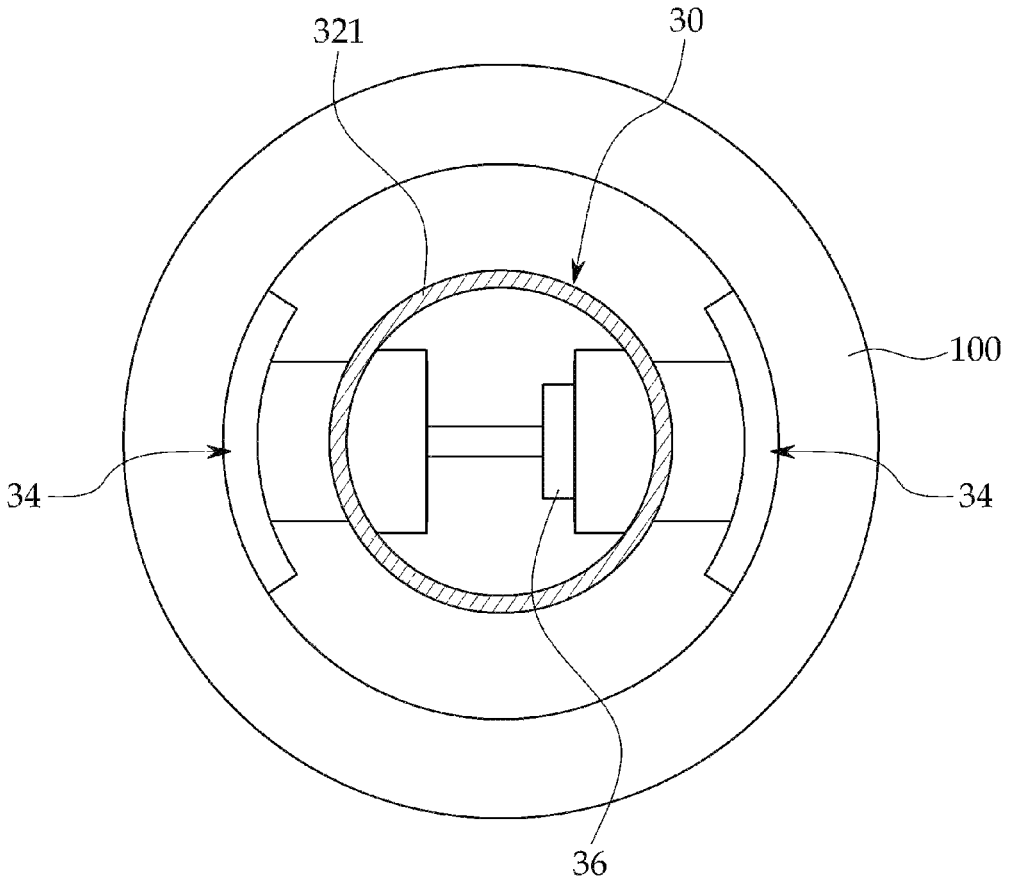

Then, when a pressurized oil is supplied to the chucking cylinder 36 of the pile lifting chuck 30, the extensions 34 connected to the chucking cylinder 36 as illustrated in FIG. 9 move in the radial direction and hold the pile 100.

In this state, when the lifting equipment 500 is driven to lift the balance plate 20, the pile lifting chuck 30 lifts the corresponding pile 100 via the first lifting cables 21. Here, since a chucking force of the chucking cylinder 36 is maintained, the lifted pile 100 may be moved to a desired position.

After the pile 100 is moved to the desired position, the chucking cylinder 36 is operated in the opposite direction to return the extensions 34 to their original positions, thus allowing the pile lifting chuck 30 to be easily detached from the pile 100. The returning of the chucking cylinder 36 to its original position may be performed by changing a direction in which the pressurized oil is supplied.

In this way, according to the present disclosure, since it is not a method in which a noose is formed using a wire to lift a pile, loosening of the wire does not occur, and thus there is no risk of the pile overturning. In addition, since it is also not a method in which an eye bolt is fastened into a bolt hole at a distal end of a pile and a wire is hung on the eye bolt to lift the pile, loosening of the eye bolt does not occur, and thus there is no risk of the pile overturning.

Figure 10:
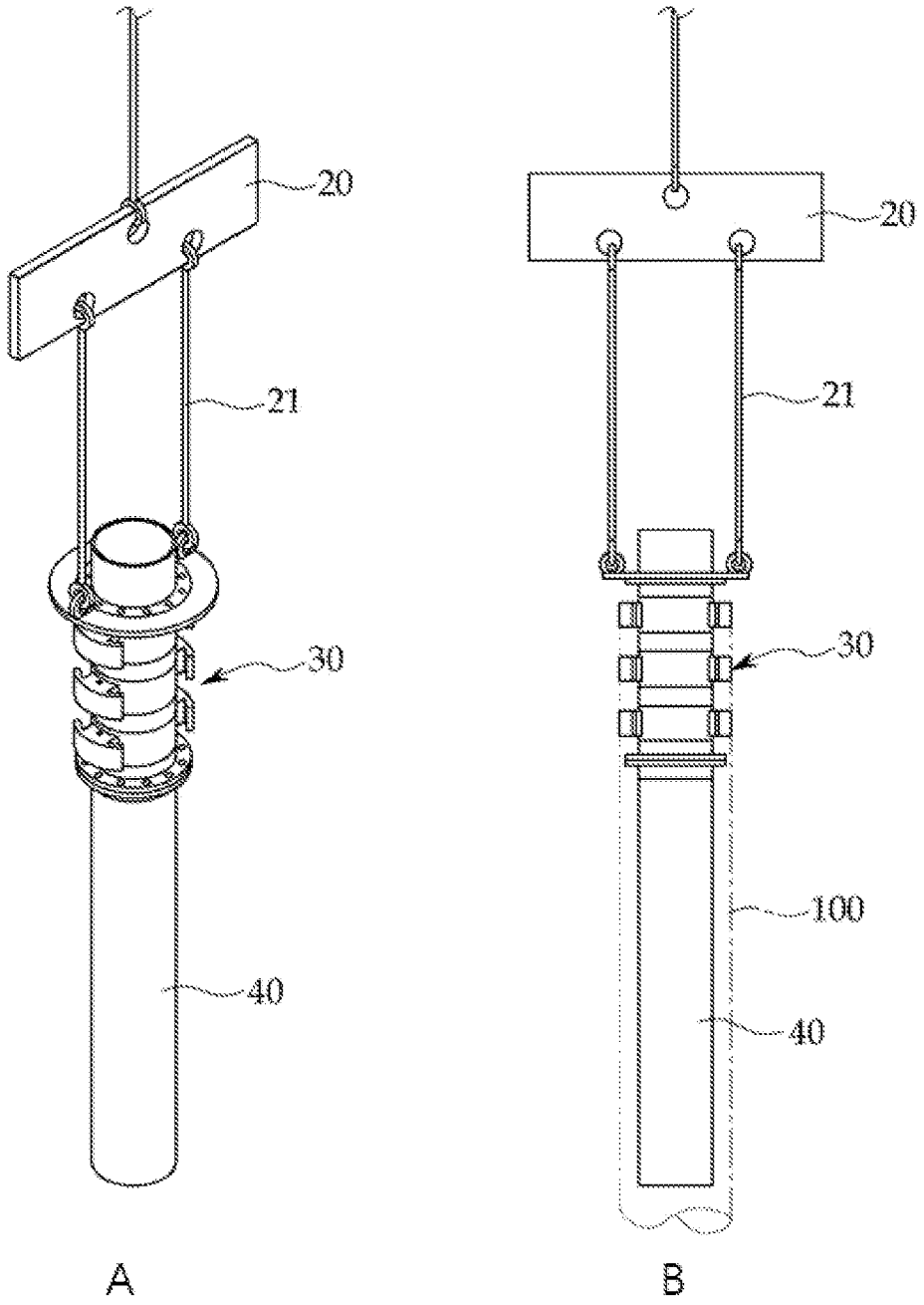
FIGS. 10A and 10B are a perspective view and a front view of a pile lifting device according to a second embodiment of the present disclosure.

Meanwhile, the pile lifting device 10 of the present disclosure may further include an overturning-preventing steel pipe 40 which has an outer diameter and a certain length that allow insertion into the inner diameter of the pile 100 and is connected to a lower end of the pile lifting chuck 30 as illustrated in FIGS. 10A and 10B.

Therefore, the overturning-preventing steel pipe 40 is inserted into the pile 100, and thus the pile 100 does not overturn even when the pile 100 moves away from the pile lifting device 10. Here, since the pile 100 is usually lifted while maintaining a distance of about 1 m to 2 m from the ground, even when the pile 100 falls to the ground while being lifted, the overturning-preventing steel pipe 40 inserted into the pile 100 may support the pile 100 to prevent detachment of the pile 100, and thus overturning of the pile 100 may be prevented.

Figure 11:
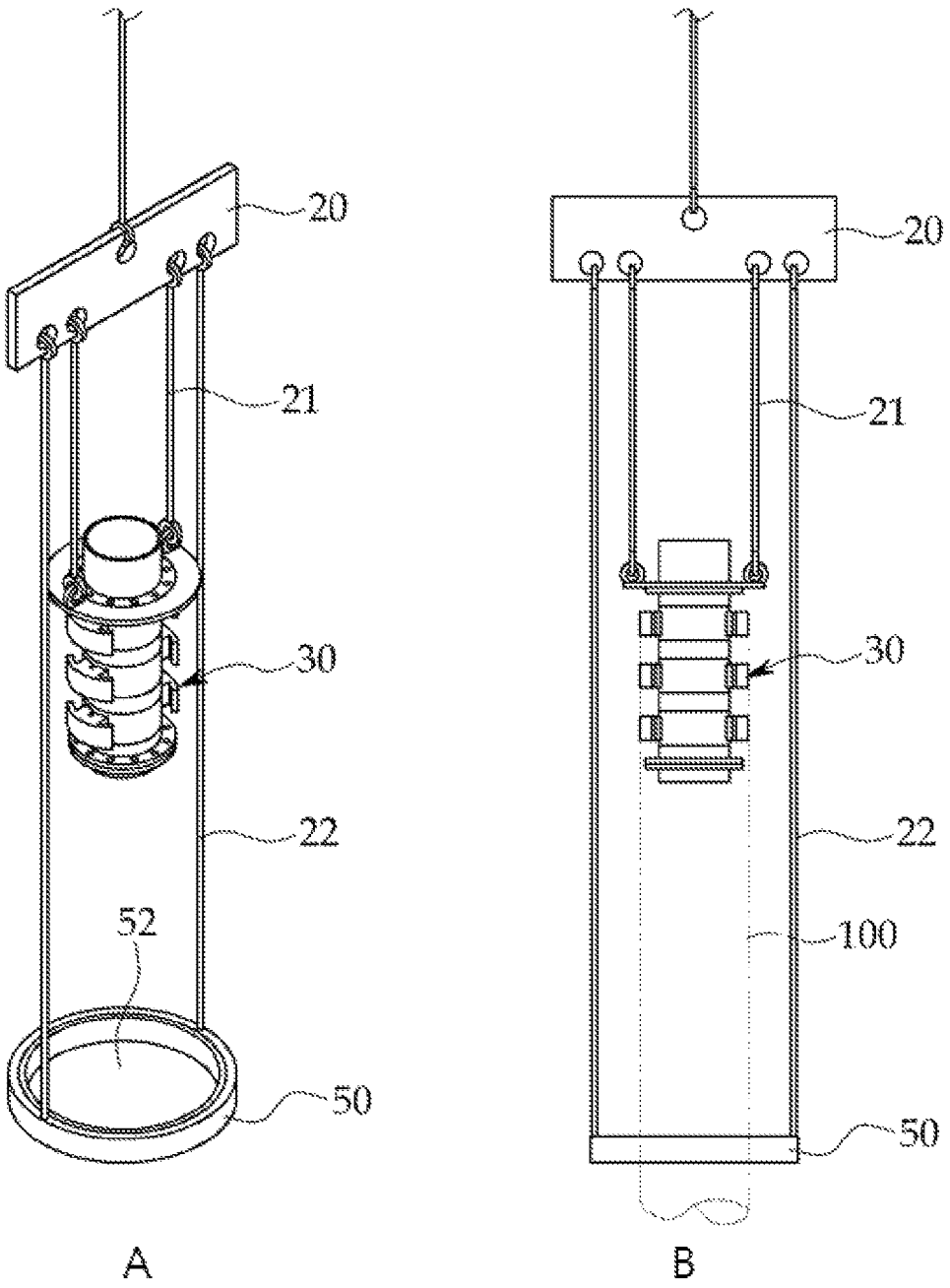
FIGS. 11A and 11B are a perspective view and a front view of a pile lifting device according to a third embodiment of the present disclosure.

Also, the pile lifting device 10 of the present disclosure may further include an overturning-preventing ring plate 50 which has an overturning-preventing hole 52 configured to accommodate an outer diameter of the pile 100 and is connected to the balance plate 20 via a plurality of second lifting cables 22 as illustrated in FIGS. 11A and 11B. Even in this case, since the pile 100 is usually lifted while maintaining a distance of about 1 m to 2 m from the ground, even when the pile 100 falls to the ground while being lifted, the overturning-preventing ring plate 50 may support the pile 100 caught therein to prevent detachment of the pile 100, and thus overturning of the pile 100 may be prevented.

Figure 12:
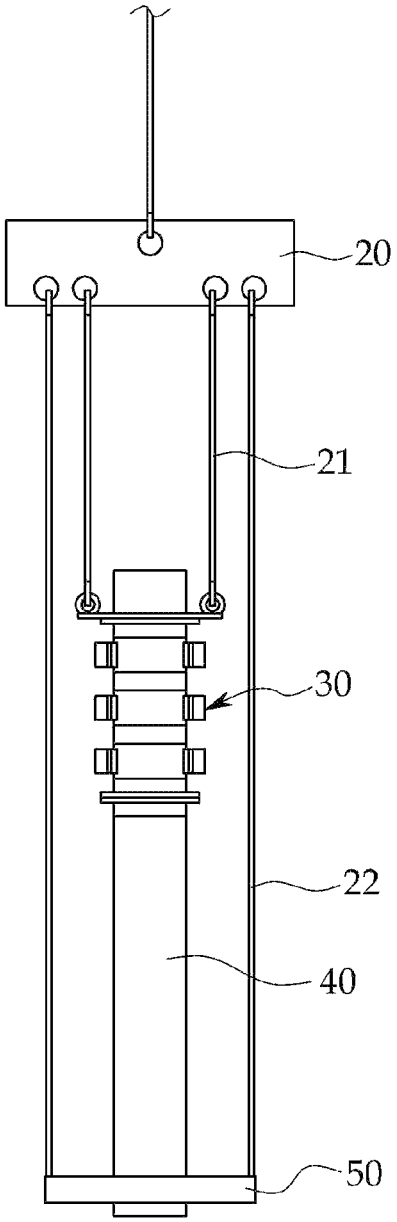
FIGS. 12 and 13 are a perspective view and a front view of a pile lifting device according to a fourth embodiment of the present disclosure.
Figure 13:
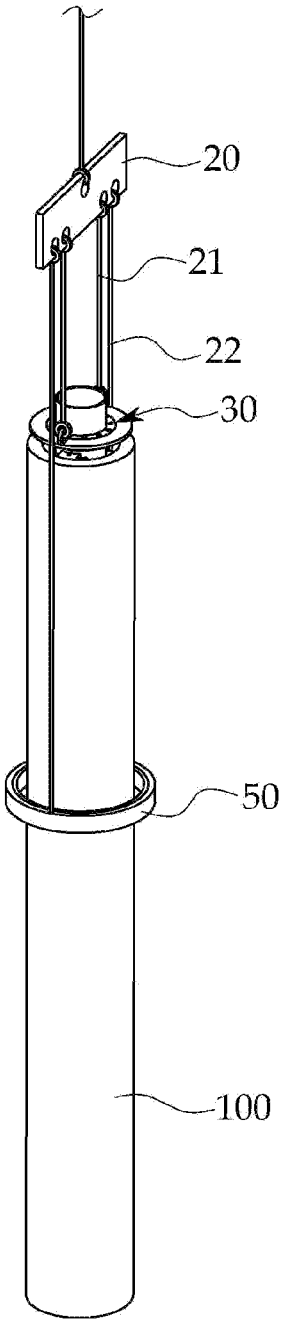

Of course, in the pile lifting device 10 of the present disclosure, in order to prevent the overturning of the pile 100 during lifting of the pile 100, the overturning-preventing steel pipe 40 and the overturning-preventing ring plate 50 may also be installed together as illustrated in FIGS. 12 and 13.

Figure 14:
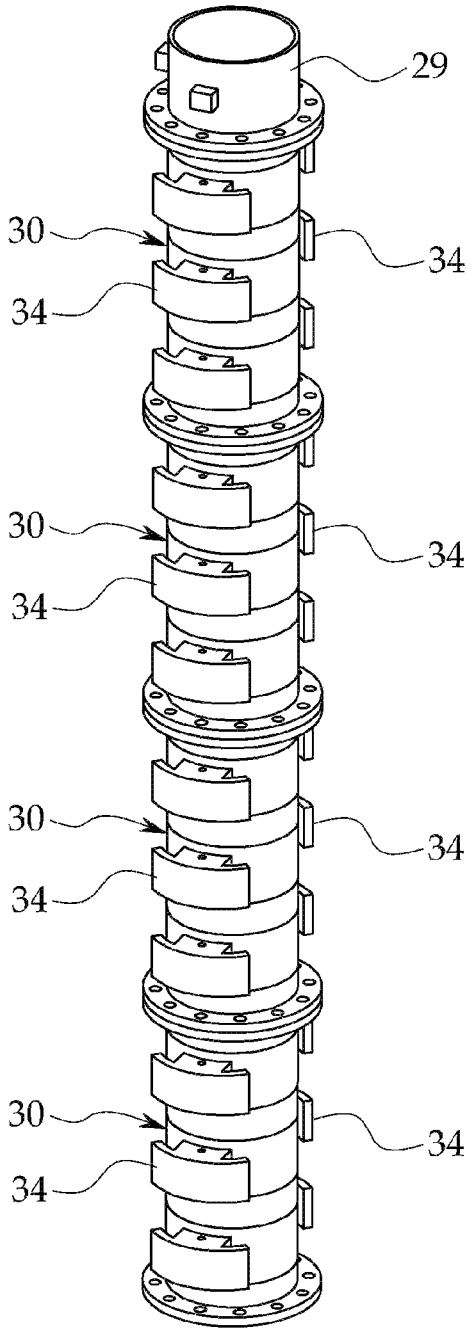
FIG. 14 is a perspective view illustrating a rotary penetration device for a pile that is configured by connecting a plurality of pile lifting chucks applied to the present disclosure in series.

On the other hand, the pile lifting chuck 30 applied to the present disclosure may be provided as a plurality of pile lifting chucks 30 coupled in series as illustrated in FIG. 14 so as to be utilized as a device that allows a pile to penetrate the ground while rotating. Here, a driving head 29 may be further installed on the uppermost portion of the pile lifting chuck 30 to allow rotary penetration. Here, a hydraulic pump or the like configured to generate hydraulic pressure to operate the chucking cylinder 36 is installed inside the driving head 29.

Figure 15:
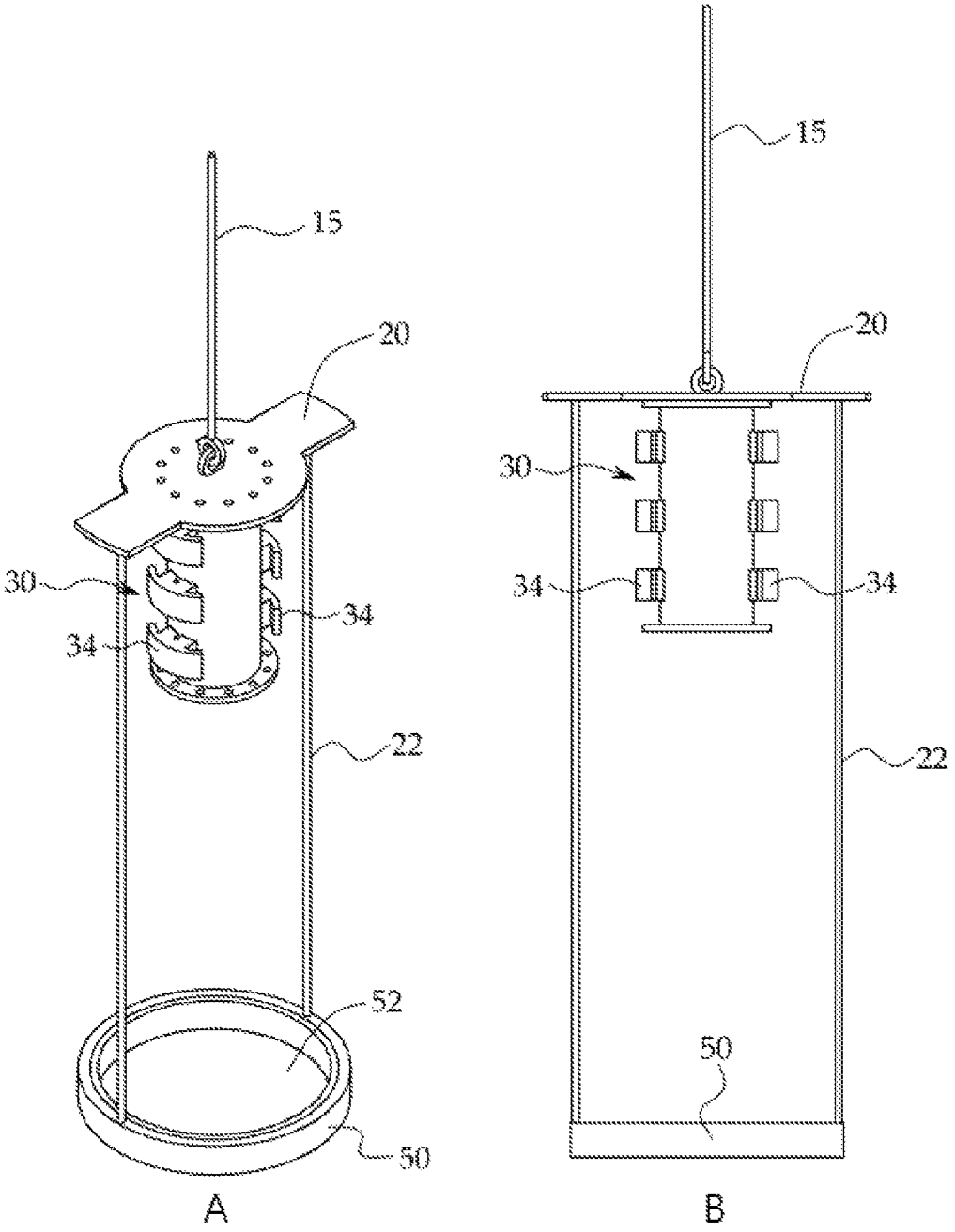
FIGS. 15A and 15B are a perspective view and a front view illustrating a state in which an overturning-preventing ring plate applied to the pile lifting device of the present disclosure is directly connected to a balance plate.
Figure 16:
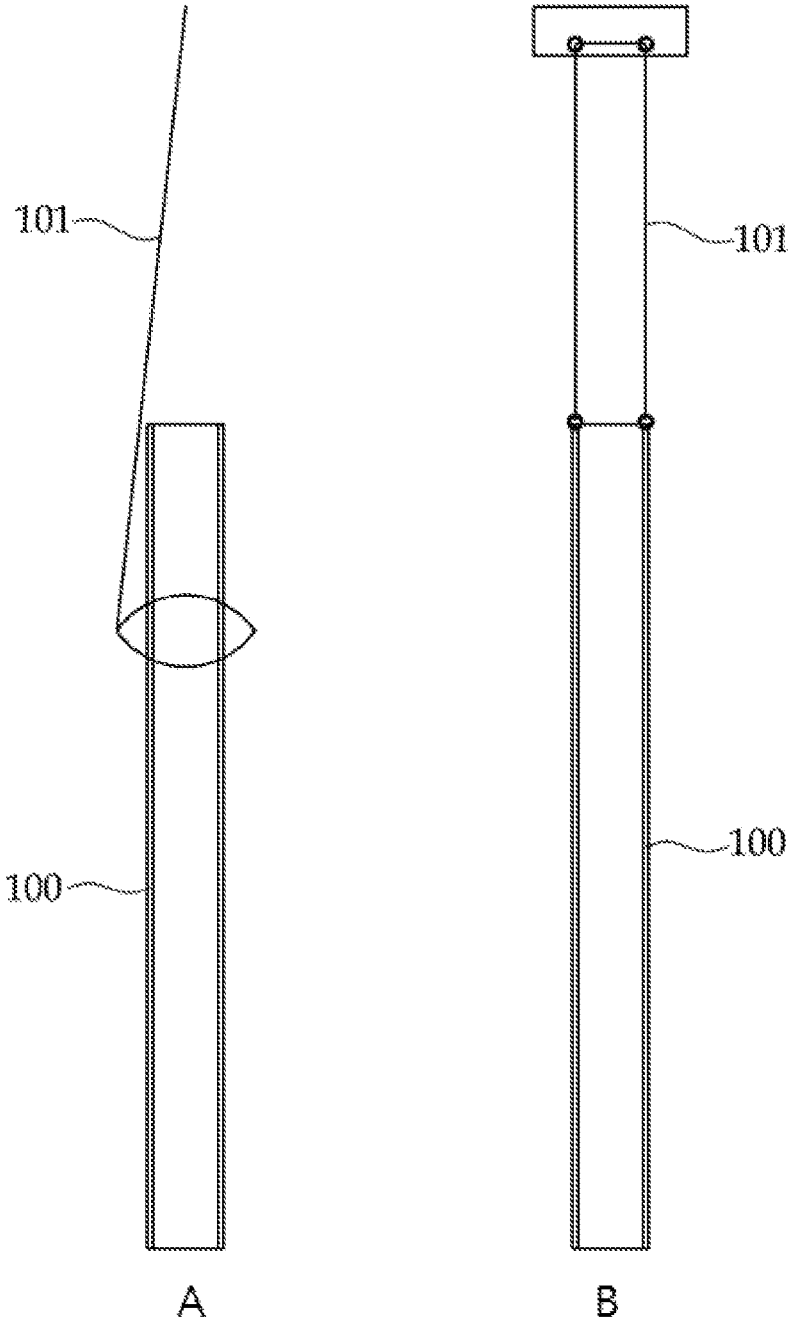
FIGS. 16A and 16B are conceptual views illustrating various conventional methods of lifting a pile on site.

Also, as illustrated in FIGS. 15A and 15B, the balance plate 20 may be directly connected to an upper portion of the pile lifting chuck 30, and here, the overturning-preventing ring plate 50 may be connected to the balance plate 20 via the second lifting cables 22.

According to a pile lifting device capable of preventing the overturning of piles of the present disclosure, a pile can be chucked and lifted by extending extensions using hydraulic pressure supplied to a pile lifting chuck.

Also, in a case where an overturning-preventing steel pipe is additionally installed at the pile lifting chuck or an overturning-preventing ring plate is additionally installed at a balance plate, it is possible to prevent the overturning of a pile while the pile is lifted and thus prevent an accident.

The present disclosure has been described in detail above with reference to the embodiments proposed herein, but those of ordinary skill in the art should be able to make various modifications and alterations to the proposed embodiments within the scope not departing from the technical spirit of the present disclosure. The present disclosure is not limited by such modifications and alterations, and the scope of the present disclosure is only defined by the attached claims.

What is claimed is:

1. A pile lifting chuck comprising:

a chuck housing which is inserted into an inner diameter of a pile and has extension-installing pockets vertically formed at predetermined intervals to face each other in a radial direction;

a pair of extensions which are disposed in the pockets and installed to be movable in the radial direction; and a chucking cylinder which has one end connected to any one of the extensions and the other end connected to the other one of the extensions and which is configured to, by using a reaction force on the any one of the extensions, move the other one of the extensions to chuck the pile.

2. The pile lifting chuck of claim 1, wherein each extension includes:

a boss which is configured to move while inserted one of the pockets;

an engaging plate which is integrally formed with the boss and disposed outside the chuck housing; and a pressing rubber plate which is attached to the engaging plate to come into contact with an inner wall of the pile.

3. A pile lifting device comprising:

the pile lifting chuck of claim 1; and a steel pipe which is inserted into an inner wall of the pile and connected to a lower end of the pile lifting chuck to, when the pile falls to the ground, support the pile so that the pile is caught and not detached.

* * * * *